US007870815B2

(12) United States Patent
Hung

(10) Patent No.: US 7,870,815 B2
(45) Date of Patent: Jan. 18, 2011

(54) GUN FLASH HIDER

(75) Inventor: Yi-Hsien Hung, Sanchong (TW)

(73) Assignee: Troika International Co., Ltd., Taipei (TW)

( * ) Notice: Subject to any disclaimer, the term of this patent is extended or adjusted under 35 U.S.C. 154(b) by 207 days.

(21) Appl. No.: 12/007,903

(22) Filed: Jan. 16, 2008

(65) Prior Publication Data

US 2010/0282056 A1 Nov. 11, 2010

(51) Int. Cl.
*F41A 21/34* (2006.01)

(52) U.S. Cl. ..... 89/14.2; 42/77

(58) Field of Classification Search ..... 89/14.2, 89/14.3, 14.4, 198; 181/223; D22/108; 42/77, 42/79

See application file for complete search history.

(56) References Cited

U.S. PATENT DOCUMENTS

| | | | | | |
|---|---|---|---|---|---|
| 1,860,276 | A * | 5/1932 | De Luce et al. | ..... | 89/14.2 |
| 2,112,831 | A * | 4/1938 | Cutts, Jr. | ..... | 89/14.3 |
| 2,206,568 | A * | 7/1940 | Hughes | ..... | 89/14.3 |
| 2,514,996 | A * | 7/1950 | Faust, Jr. | ..... | 181/223 |
| 2,796,005 | A * | 6/1957 | Shapel | ..... | 89/14.3 |
| 2,872,848 | A * | 2/1959 | Schuessler | ..... | 89/14.3 |
| 2,883,781 | A * | 4/1959 | Harvey | ..... | 42/105 |
| 4,576,083 | A * | 3/1986 | Seberger, Jr. | ..... | 89/14.4 |
| 4,974,489 | A * | 12/1990 | Fishbaugh | ..... | 89/14.4 |
| 5,164,535 | A * | 11/1992 | Leasure | ..... | 89/14.4 |
| 5,367,940 | A * | 11/1994 | Taylor | ..... | 89/14.3 |
| 7,207,258 | B1 * | 4/2007 | Scanlon | ..... | 89/198 |
| 7,237,467 | B1 * | 7/2007 | Melton | ..... | 89/14.4 |
| 7,290,475 | B2 * | 11/2007 | Fluhr | ..... | 89/14.5 |
| 7,308,967 | B1 * | 12/2007 | Hoel et al. | ..... | 181/223 |
| 2007/0017357 | A1 * | 1/2007 | Fluhr | ..... | 89/14.2 |
| 2007/0107590 | A1 * | 5/2007 | Silvers | ..... | 89/14.4 |
| 2007/0266844 | A1 * | 11/2007 | Dueck | ..... | 89/14.4 |
| 2009/0107325 | A1 * | 4/2009 | Poulsen | ..... | 89/14.2 |
| 2009/0193963 | A1 * | 8/2009 | Poulsen | ..... | 89/14.2 |

* cited by examiner

*Primary Examiner*—Benjamin P Lee
(74) *Attorney, Agent, or Firm*—Muncy, Geissler, Olds & Lowe, PLLC

(57) ABSTRACT

A gun flash hider, formed to include a first expansion chamber, a first flow divider, a plurality of first exhaust passages, an exhaust head, a second expansion chamber, a plurality of second exhaust passages and a second flow divider, whereby high-temperature high-pressure gas produced after firing a bullet undergoes two expansion decompressions and two flow diversion decompressions, through which the gas is sequentially discharged from the first exhaust passages and the second exhaust passages, thereby substantially reducing sonic boom volume, amount of flame and recoil force produced when firing the bullet, and increasing stability and shooting accuracy when using a gun.

6 Claims, 7 Drawing Sheets

GUN FLASH HIDER

BACKGROUND OF THE INVENTION (a) Field of the Invention

A gun flash hider fitted to the front end of a firearm or cannon, which is able to reduce sonic boom volume, amount of flame and recoil force produced when firing the firearm or cannon.

(b) Description of the Prior Art

Currently, the flash hiders used in the most commonly seen firearms and cannons are of circular tube form, an internal penetrating space of which assumes a conical shape, and the tubular walls of the flash hider is provided with a plurality of strip exhaust passages. After firing the gun or cannon, the energy generated from the combustion explosion of the gunpowder is used to project a bullet. However, a large amount of gas is instantaneously released after combustion explosion of the gunpowder, and when the high-temperature high-pressure gas passes through the flash hider, then the conical shaped inner barrel and the strips of exhaust passages on the barrel walls are used to effect a one-time diffusion and discharge of the high-temperature high-pressure gas released after combustion explosion of the gunpowder to suppress the sonic boom volume and amount of flame produced when a flash hider is not installed. However, the sonic boom volume and amount of flame produced after installing such a flash hider of the prior art are still substantial, with the result that the location of the shooter firing the gun is easily exposed when firing in insufficient light or at night. Moreover, recoil force generated after firing the firearm or cannon differs according to the different types of ammunition and amount of gunpowder used. Hence, jerking of the firing plane of the firearm or cannon is affected, and stability and shooting accuracy is reduced when using the gun or cannon. Accordingly, there is a need for improvement in prior art.

SUMMARY OF THE INVENTION

In light of the inability of flash hiders of prior art to effectively reduce sonic boom volume and the amount of flame produced when firing a gun, the inventor of the present invention has meticulously carried out extensive study and research in aerodynamics to resolve the technical difficulties in overcoming the inability of the flash hiders of prior art being unable to improve use effectiveness to ultimately designed a new improved gun flash hider.

A primary objective of the present invention is to provide a gun flash hider able to reduce sonic boom volume, amount of flame and recoil force produced when firing a gun, and which enables increasing stability and shooting accuracy when using the gun.

In order to achieve the aforementioned objectives, the gun flash hider of the present invention comprises a first expansion chamber, a first flow divider, a plurality of first exhaust passages, an exhaust head, a second expansion chamber, a plurality of second exhaust passages and a second flow divider. After joining the gun flash hider of the present invention to a gun barrel or cannon barrel, and after firing, whereupon combustion explosion of the gunpowder provides a bullet with kinetic energy, thereby causing the bullet to advance along the gun barrel or cannon barrel and the passageway formed by the gun flash hider. Before the bullet leaves the gun barrel or cannon barrel, gas originally located within the barrel or cannon barrel is first discharged into a first expansion chamber, at which time, a first flow divider causes a portion of the gas to undergo first flow divergence, causing the gas to flow into first exhaust passages joined to the first flow divider, after which the gas is discharged to the atmosphere from an exhaust head joined to the first exhaust passages. Because of the rectilinear motion of the gas flow within the first exhaust passages, thus, the gas integrates with the air flow exterior of the flash hider after being discharged therefrom. Then, after the bullet passes through the first expansion chamber, the high-temperature high-pressure gas produced by combustion explosion of the gunpowder is also guided into the first expansion chamber, whereupon the high-temperature high-pressure gas undergoes first gas expansion to achieve effectiveness of a small temperature decrease and reduction in pressure. Similarly, functionality of the first flow divider causes a portion of the high-temperature high pressure gas to undergo first gas divergence, thereby causing the diverted high-temperature high-pressure gas to flow along the first exhaust passages joined to the first flow divider, after which the gas is finally discharges from the exhaust head. Furthermore, a portion of the gunpowder might not undergo complete combustion during combustion explosion of the gunpowder, but will enter the first expansion chamber along with the high-temperature high-pressure gas flow and continue to undergo first combustion therein and the waste gas discharged, thereby eliminating sonic boom and flame produced by combustion explosion of the gunpowder. When the high-temperature high-pressure gas steadily enters the first exhaust passages at high speed and discharged from the exhaust head, then an invisible high pressure gas wall is produced at a periphery of the exhaust head, as well as creating a vacuum region thereat, which prevents disturbance of the flight path of the bullet due to the trajectory of the bullet and the vacuum region overlapping when the bullet is projected from the gun flash hider. Finally, when the bullet reaches the opening of the flash hider, the high-temperature high-pressure gas left over from the first gas divergence enters a second expansion chamber, where the gas undergoes second expansion and a decrease in temperature and reduction in pressure; and gunpowder that has not undergone complete combustion can enter the second expansion chamber and undergo second combustion. A portion of the high-temperature high-pressure gas, sonic boom and flame are discharged to the atmosphere from the second exhaust passages joined to the second expansion chamber before to the second flow divider, thereby eliminating the sonic boom and flame produced by combustion explosion within the second expansion chamber. Hence, after firing each bullet or shell, both gas expansion and gas divergence occur twice within the flash hider, and the gas is respectively discharged to the atmosphere from the first exhaust passages and the second exhaust passages.

In conclusion, the inventor of the present invention in its use of aerodynamic principles provides additional expansion decompression and flow diversion decompression interior of the gun flash hider of the present invention, as well as unique aerodynamic technology of gas diversion discharge to substantially reduce sonic boom volume, amount of flame and recoil force when firing a bullet or shell, thereby thoroughly improving the exasperating shortcomings evident when firing the original firearm and cannon. Moreover, because of the pre-discharge decompressions, thereby reducing single discharge amount of high-temperature high-pressure gas after combustion of the gunpowder, and reducing discharge pressure, thus, the recoil force produced and jerking of the gun when firing is evidently reduced, and consequently stability is also greatly increased when firing.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
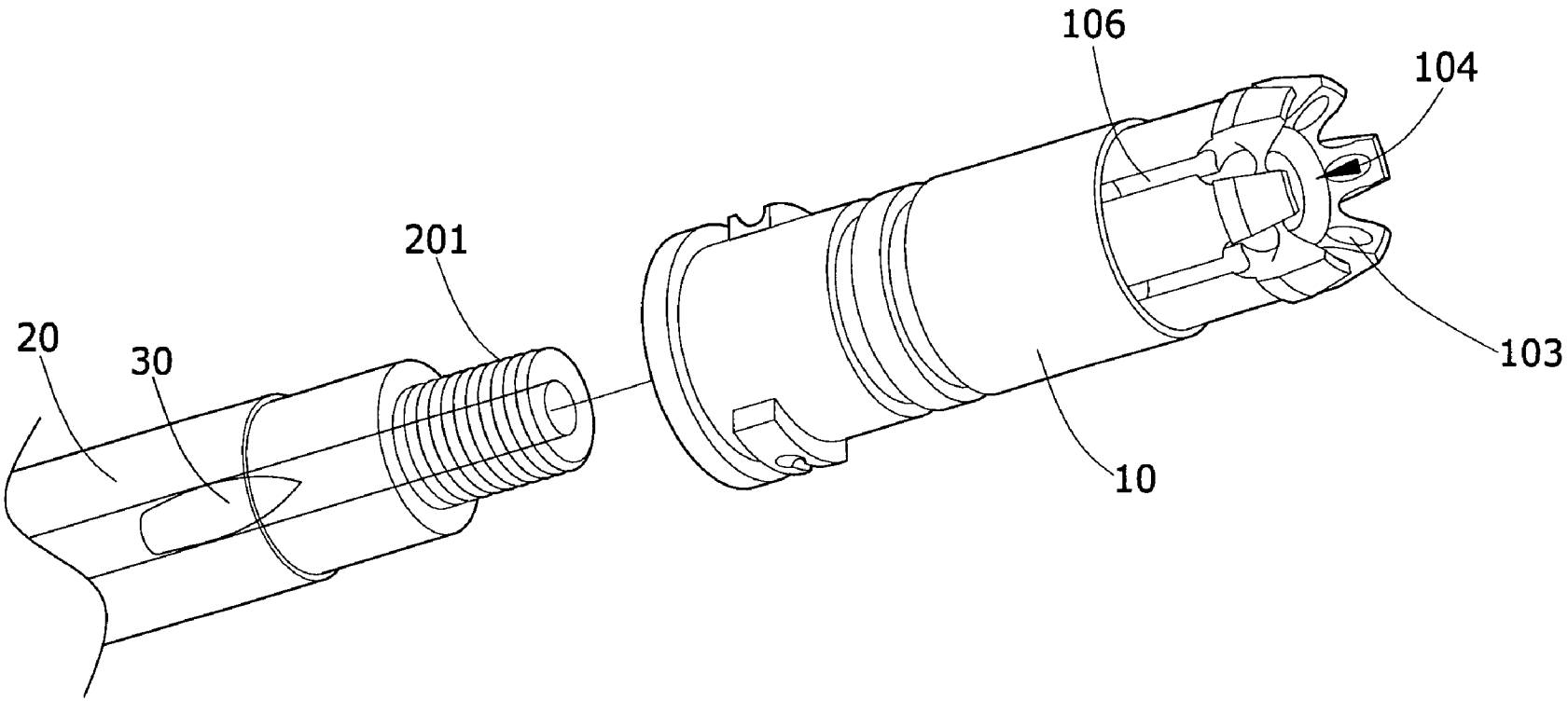
FIG. 1 shows a schematic view depicting joining of a preferred embodiment of the present invention to a gun.

Referring to FIG. 1, which shows a schematic view depicting joining of a preferred embodiment of the present invention to a gun, wherein a gun flash hider 10 of the present invention is used in combination with a common firearm or cannon. Taking a firearm as an example a front end of a barrel 20 of the firearm forms a threaded portion 201 correspondingly enabling assembly of the gun flash hider 10 of the present invention thereto. After joining the gun flash hider 10 of the present invention to the barrel 20, when a bullet 30 is fired, then the high-temperature, high-pressure gas produced from combustion explosion of the gunpowder, after multiple expansion decompression, flow diversion decompression and exhaust decompression, the high-temperature high-pressure gas is sequentially discharged from first exhaust passages 103 and second exhaust passages 106 located at the surface of the gun flash hider 10 and an exhaust head 104, where the gas integrates with the atmosphere at the front end of the gun flash hider 10 to form an invisible high pressure gas wall, and creates a vacuum region, thereby reducing the affect on the trajectory of the bullet 30 from air turbulence produced at the outlet when the bullet 30 projects from the exhaust head 104. Moreover, during the firing process of the bullet 30, gas is discharged twice (altogether three times along with movement of the bullet 30 through the barrel passageway), which compared with flash hiders of the prior art, in which gas is only discharged one time at the outlet of the front end, the present invention is able to more effectively reduce sonic boom volume, amount of flame and recoil force produced when firing the bullet 30, thereby increasing stealthiness and improving stability and shooting accuracy when using the gun.

Figure 2:
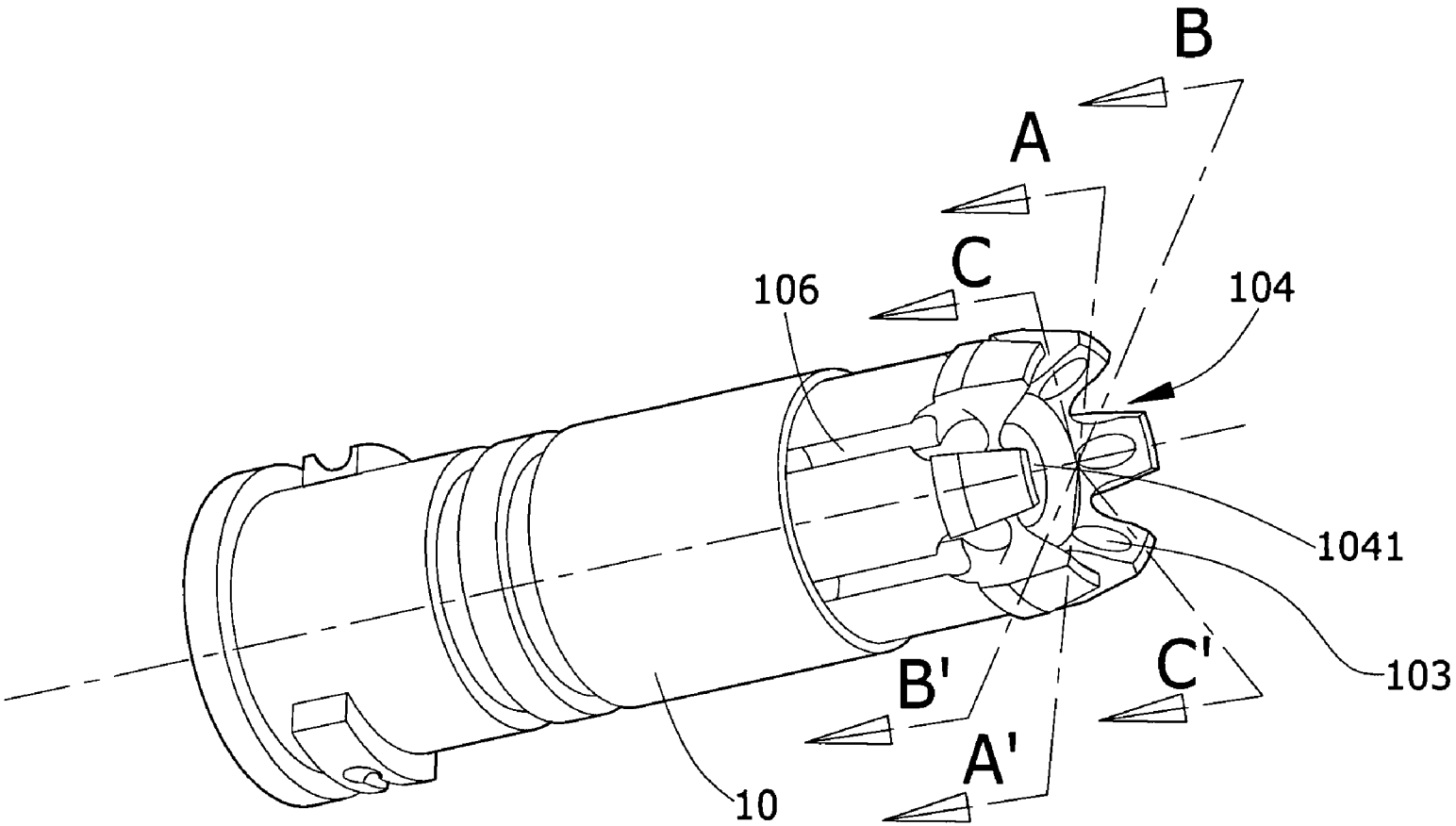
FIG. 2 shows an outward appearance of an elevational view of the preferred embodiment according to the present invention.

Referring to FIG. 2, which shows an outward appearance of an elevational view of the preferred embodiment according to the present invention, wherein the gun flash hider 10 assumes a tubular form, and a through hole 1041 is formed in the center of the exhaust head 104 at the front end of the gun flash hider 10. Moreover, a plurality of apertures which afford passage to the first exhaust passages 103 are formed close to the through hole 1041. The first exhaust passages 103 are annularly disposed to the exhaust head 104, and the plurality of second exhaust passages 106 are formed between pairs of the adjacent first exhaust passages 103 by slotting means. Hence, from an anterior view, the first exhaust passages 103 and the second exhaust passages 106 of the gun flash hider 10 assume a staggered annular disposition. In addition, the internal structure of the gun flash hider 10 of the present invention can be seen from a cutaway view along A-A' and a cutaway view along B-B'.

Figure 3:
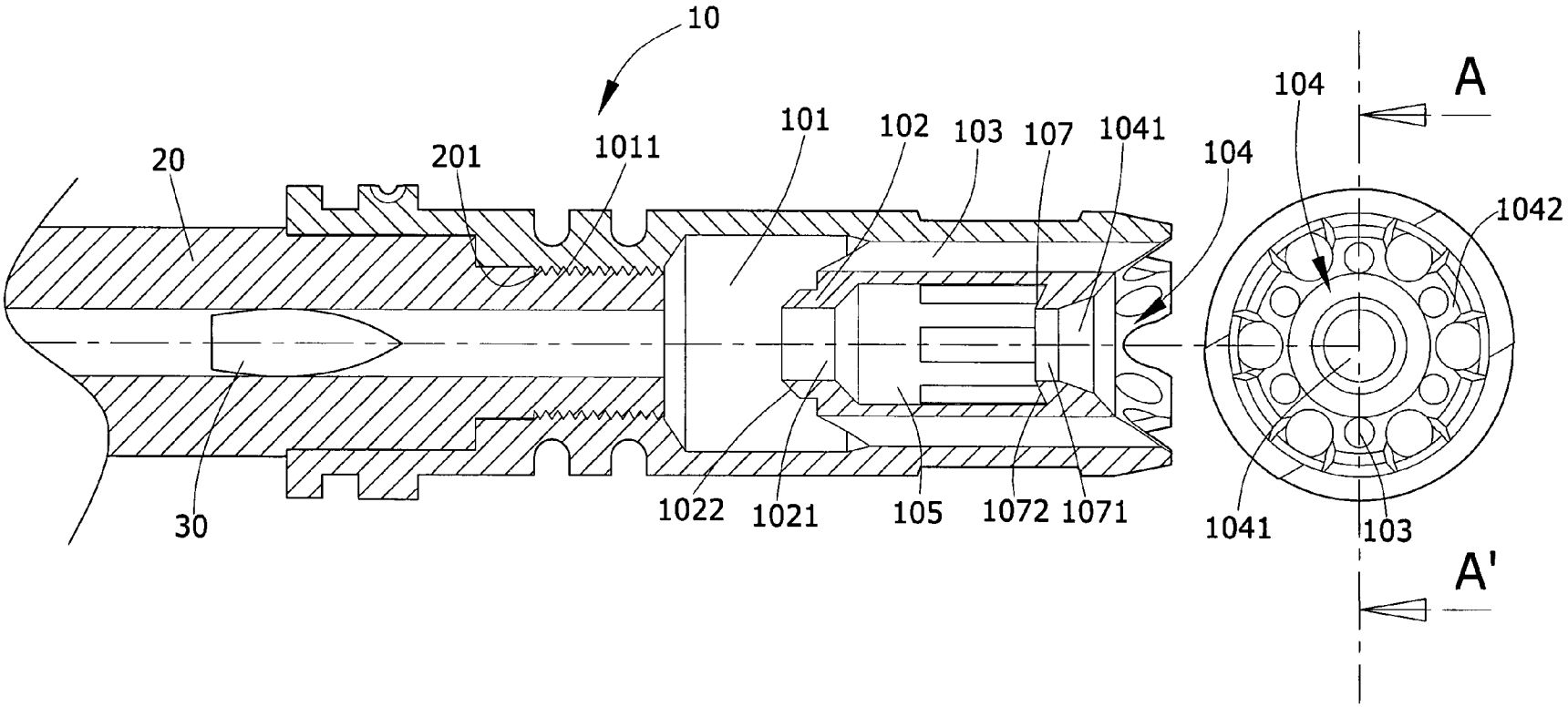
FIG. 3 shows a cutaway view along A-A' of the preferred embodiment of the present invention.
Figure 4:
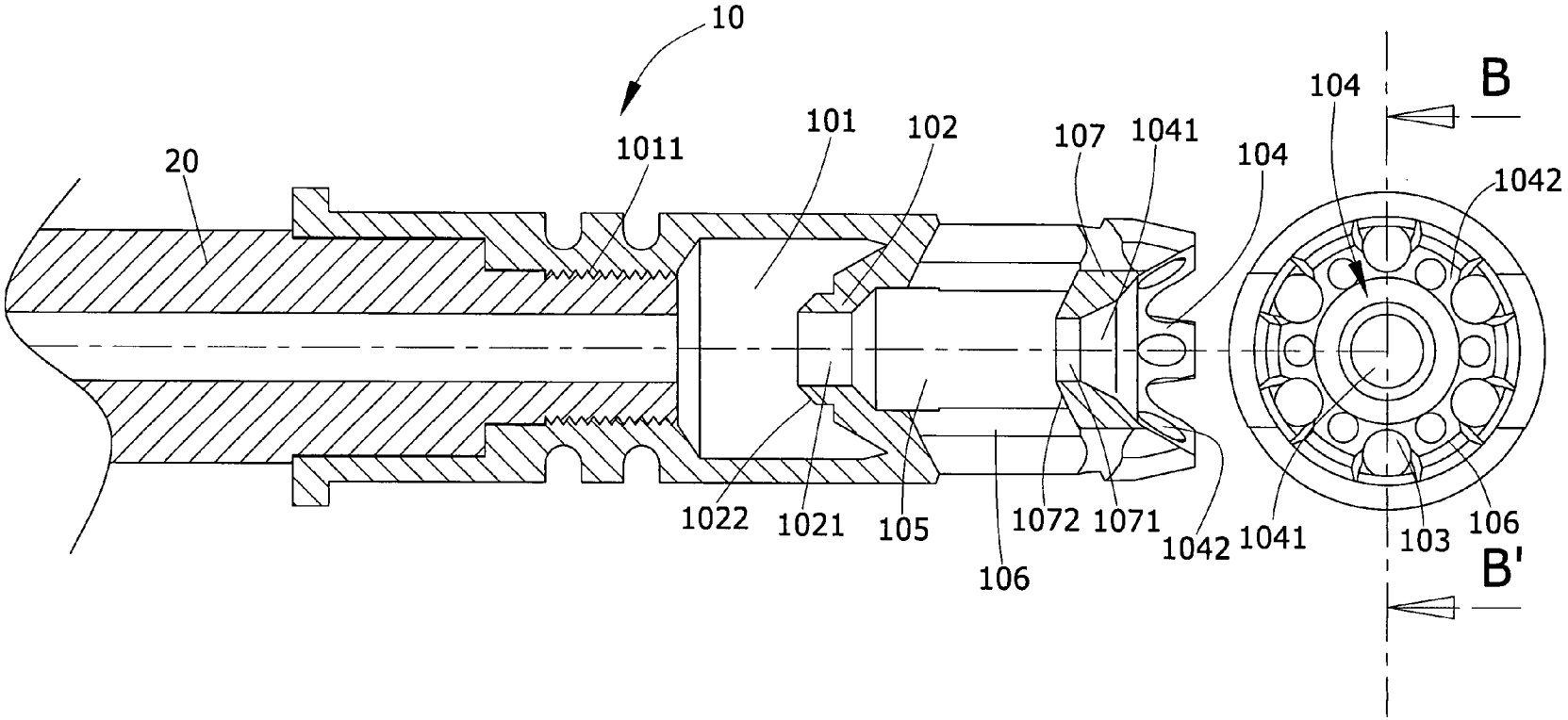
FIG. 4 shows a cutaway view along B-B' of the preferred embodiment of the present invention.

Referring to FIG. 3, which shows a cutaway view of the preferred embodiment of the present invention, wherein the gun flash hider 10 primarily comprises: A first expansion chamber 101, which is formed at one end of the gun flash hider 10 of the present invention, and a holding space is formed interior of the first expansion chamber 101. A threaded portion 1011 is formed at an open end of the first expansion chamber 101, and the threaded portion 1011 enables the gun flash hider 10 to be screwed onto the aforementioned corresponding threaded portion 201 located at the end of the barrel 20. Hence, after firing the bullet 30, gas expelled from the aforementioned barrel 20 undergoes first expansion decompression within the first expansion chamber 101. A first flow divider 102 is further formed at a closed end of the first expansion chamber 101, and a through hole 1021 is defined center of the first flow divider 102; and the first flow divider 102 enables gas located within the first expansion chamber 101 to undergo first flow diversion decompression. Furthermore, the first flow divider 102 corresponds to the direction of the gas flow, and the first flow divider 102 forms a stepladder-like tapered face portion 1022. A plurality of the first exhaust passages 103, which are annular formed on the outer side of the first flow divider 102, provide flow passages for the gas that has undergone first flow diversion decompression. The exhaust head 104, which is formed at the other end of the gun flash hider 10 of the present invention, is provided with the through hole 1041 formed center thereof, and the exhaust head 104 affords passage to the plurality of first exhaust passages 103, thereby enabling discharge of the gas that has undergone first flow diversion decompression to the atmosphere. Moreover, the exhaust head 104 forms an inverted tapered face portion 1042. A second expansion chamber 105 is further formed at one side of the first flow divider 102 relative to the first expansion chamber 101, and the second expansion chamber 105 forms a holding space which enables the gas that has undergone first flow diversion decompression to undergo second expansion decompression. Referring to FIG. 4, which shows a cutaway view along B-B' of the preferred embodiment of the present invention, wherein the plurality of second exhaust passages 106 are annular formed on periphery sidewalls of the second expansion chamber 105, thereby enabling the gas that has undergone second expansion decompression to be discharged to the atmosphere. Moreover, the plurality of second exhaust passages 106 and the plurality of first exhaust passages 103 form a staggered annular disposition. The gun flash hider 10 further comprises a second flow divider 107, which is formed at one end of the second expansion chamber 105, and a through hole 1071 is formed in the center of the second flow divider 107. The through hole 1071 affords passage to the exhaust head 104, and the second flow divider 107 forms a stepladder-like tapered face portion 1072, thereby enabling the gas located within the second expansion chamber 105 to undergo second flow diversion decompression.

Figure 5:
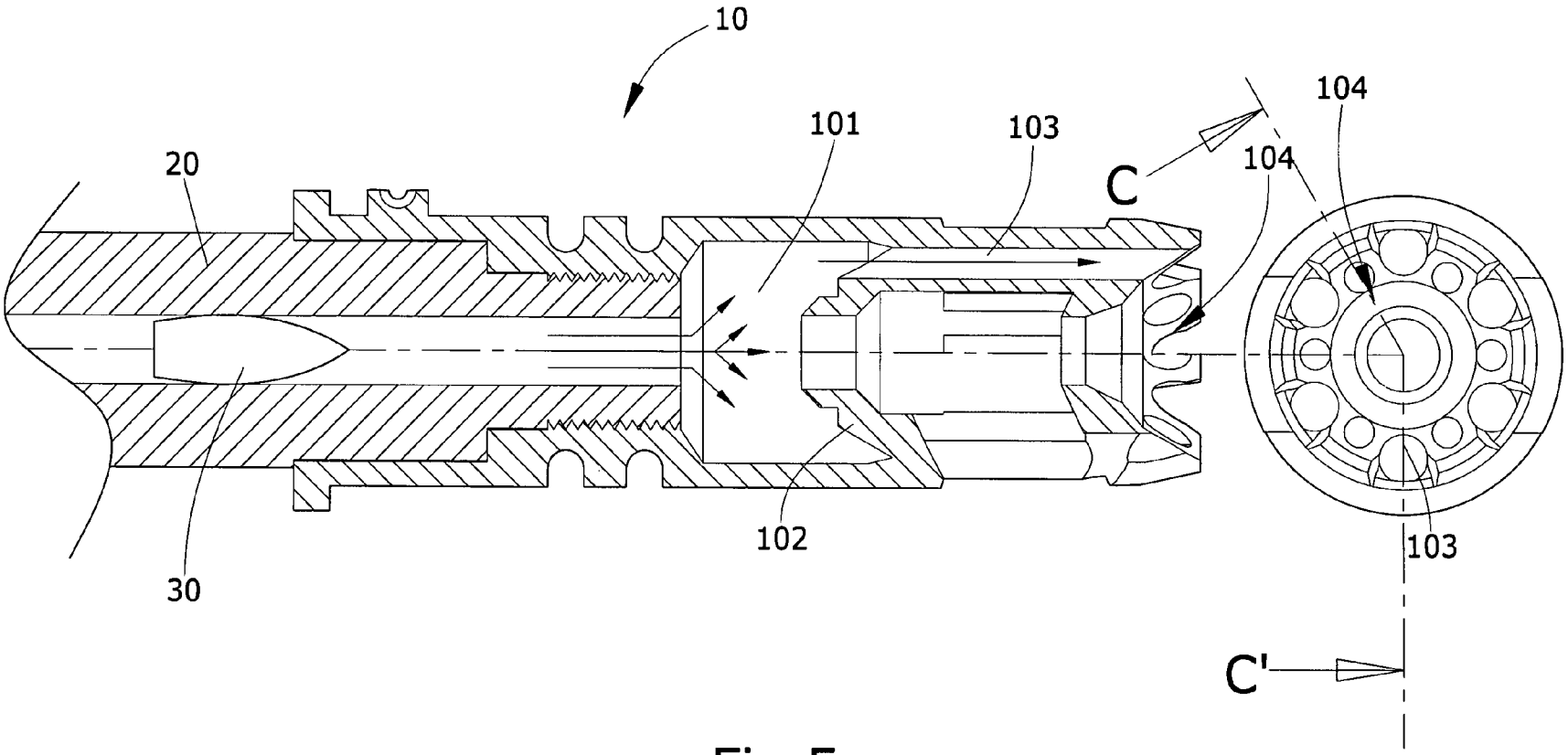
FIG. 5 shows a schematic view (1) of the preferred embodiment depicting action after firing a bullet according to the present invention.

Referring to FIG. 5, which shows a schematic view (1) of the preferred embodiment depicting action after firing a bullet according to the present invention, wherein after joining the gun flash hider 10 of the present invention to the barrel 20 (see sectional view along the line C-C'), and after firing the bullet 30, then combustion explosion of the gunpowder provides the bullet 30 with adequate kinetic energy, which enables the bullet 30 to first disperse the air within the barrel 20 into the first expansion chamber 101 before leaving the barrel 20, whereupon the first flow divider 102 functions to cause the gas flow to divide, after which the flow divided gas flows along the first exhaust passages 103 joined to the first flow divider 102. Finally, the gas is discharged out the exhaust head 104 into the atmosphere.

Figure 6:
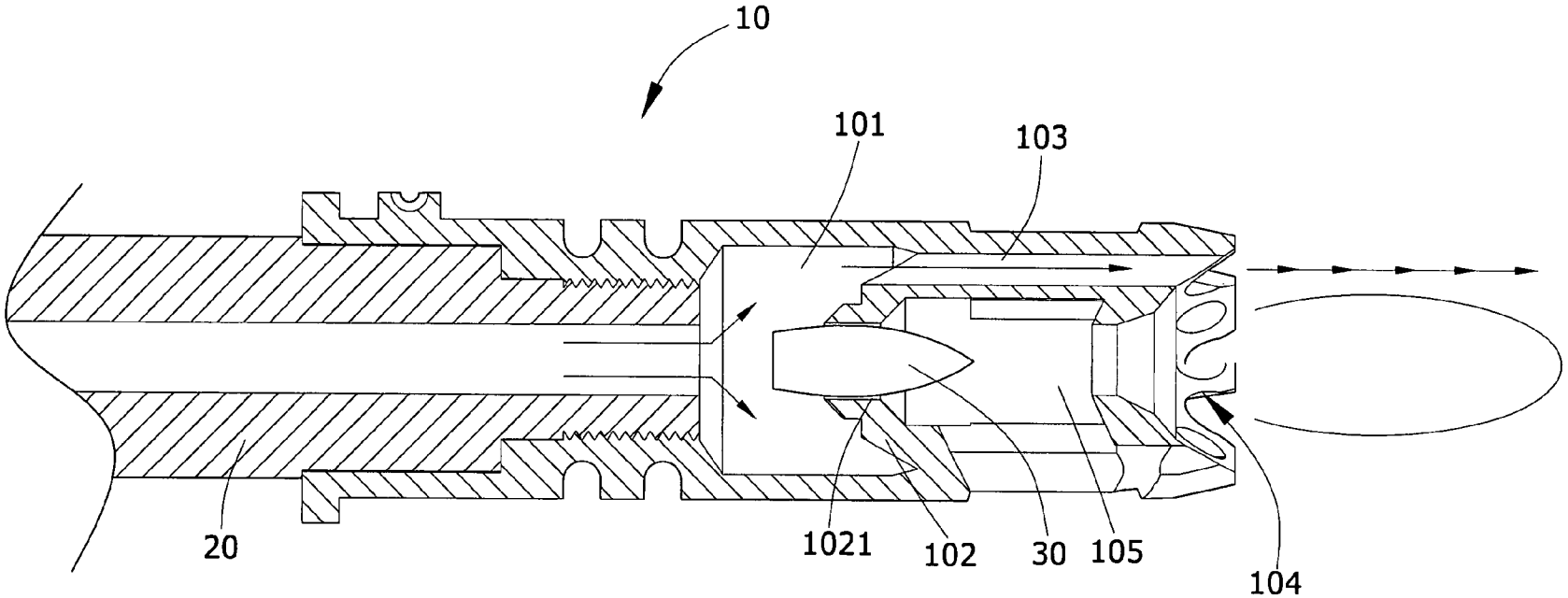
FIG. 6 shows a schematic view (2) of the preferred embodiment depicting action after firing a bullet according to the present invention.

Referring to FIG. 6, which shows a schematic view (2) of the preferred embodiment depicting action after firing a bullet according to the present invention, wherein, after the bullet 30 passes through the first expansion chamber 101, then the high-temperature high-pressure gas produced by the combustion explosion of the gunpowder is also instantaneously guided into the first expansion chamber 101. Moreover, a portion of the gunpowder might not undergo complete combustion during combustion explosion of the gunpowder in the barrel 20, but will enter the first expansion chamber 101 along with the high-temperature high-pressure gas flow and continue to undergo first combustion therein and the waste gas discharged. Accordingly, the front end of the gun flash hider 10 of the present invention only produces a weak flame, thereby achieving the objectives of reducing sonic boom volume and amount of flame produced. Furthermore, following the first flow divider 102 causing the high-temperature high-pressure gas to undergo first flow diversion decompression, then a portion of the flow divided gas passes through the first exhaust passages 103 and discharged to the atmosphere while another portion enters the second expansion chamber 105 through the through hole 1021 of the first flow divider 102. When the high-temperature high-pressure gas steadily enters the first exhaust passages 103 at high speed and discharged from the exhaust head 104, then an invisible high pressure gas wall is produced at a periphery of the exhaust head 104, as well as creating a vacuum region thereat, which prevents disturbance of the flight path of the bullet 30 due to the trajectory of the bullet 30 and the vacuum region overlapping when the bullet 30 is projected from the gun flash hider 10 of the present invention. Accordingly, trajectory stability is not affected by gas turbulence exterior of the barrel 20 after the bullet 30 is projected from the barrel 20.

Figure 7:
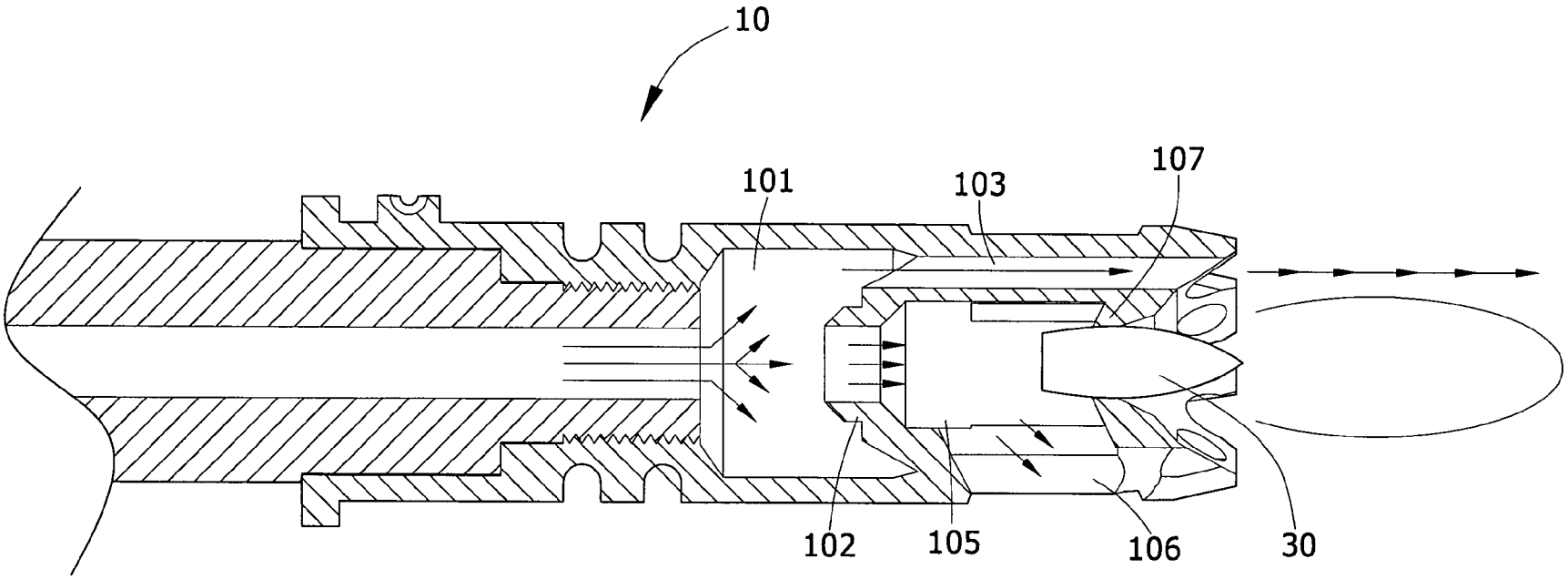
FIG. 7 shows a schematic view (3) of the preferred embodiment depicting action after firing a bullet according to the present invention.

Referring to FIG. 7, which shows a schematic view (3) of the preferred embodiment depicting action after firing a bullet according to the present invention, wherein, finally, when the bullet 30 reaches the gun flash hider 10 of the present invention, then the remaining high-temperature high-pressure gas after passing through the first flow divider 102 undergoes second expansion decompression in the second expansion chamber 105; and after the high-temperature high-pressure gas passes through the second flow divider 107 and undergoes second flow diversion decompression, then the gas flows along the second exhaust passages 106 of the periphery of the second expansion chamber 105 and discharged out to the atmosphere. Because the high-temperature high-pressure gas, after combustion explosion of the gunpowder, undergoes two expansion decompressions and two flow diversion decompressions, as well as realizing effectiveness of two gas discharges, thus, sonic boom volume and amount of flame from the combustion explosion are eliminated by the first expansion chamber 105 and the second expansion chamber 101. Moreover, interleaving, overlapping and juxtaposed disposition of the aforementioned first exhaust passages 103 and second exhaust passages 106 are used to discharge gas, thereby enabling lowering the momentary sonic boom volume when firing a firearm, and reducing the amount of flame produced after firing the firearm, as well as reducing the recoil force and improving stability and shooting accuracy when firing the firearm.

According the above description, when implementing the present invention, the gun flash hider 10 is assembled to the front end of a gun barrel or a cannon barrel, and expansion decompression, flow diversion decompression and the unique aerodynamic technology of gas diversion discharge are used to enable fractional decompression and discharge at different times of the gas produced when combustion explosion of the gunpowder occurs, thereby greatly reducing the sonic boom volume, amount of flame and recoil force produced compared to flash hiders of the prior art which only provide a single passage for the gas to pass through and be released. Accordingly, the present invention assuredly achieves the objectives of providing the gun flash hider 10 which is able to substantially reduce the sonic boom volume, amount of flame and the recoil force, as well as improving stability and shooting accuracy when firing a firearm.

In conclusion, effectiveness of the gun flash hider 10 of the present invention provides industrial practicability, originality and advancement, thus complying with the essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A gun flash hider, for joining to a gun barrel or cannon barrel to reduce sonic boom volume, the amount of flame and recoil force when firing a bullet, comprising:

a first expansion chamber formed at one end of the gun flash hider, a threaded portion being formed at an open end of the first expansion chamber, thereby enabling first expansion decompression of gas derived from the gun barrel or cannon barrel;

a first flow divider formed at a closed end of the first expansion chamber, a through hole being formed at a center of the first flow divider, thereby enabling first flow diversion decompression of the gas located within the first expansion chamber;

a plurality of first exhaust passages annularly formed on an outer side of the first flow divider, parallel to a longitudinal axis of said gun flash hider, providing flow passage portions for gas after undergoing first flow diversion decompression;

an exhaust head formed at another end of the gun flash hider, a through hole being formed at a center of the exhaust head, and the plurality of first exhaust passages afford passage to the exhaust head, each passage connecting to a separate opening in the exhaust head, the openings annularly surrounding said through hole, thereby enabling discharge of the gas to the atmosphere after undergoing first flow diversion decompression;

a second expansion chamber formed at one side of the first flow divider relative to the first expansion chamber, thereby enabling second expansion decompression of the gas after undergoing first flow diversion decompression;

a plurality of second exhaust passages annularly formed on the second expansion chamber, each passage connecting to a separate opening in a sidewall of the exhaust head, thereby enabling discharge of the gas to the atmosphere after undergoing second expansion decompression; and a second flow divider formed at one end of the second expansion chamber, a through hole being formed at a center of the second flow divider, and the through hole affords passage to the exhaust head, thereby enabling second flow diversion decompression of gas located within the second expansion chamber.

2. The gun flash hider according to claim 1, wherein the first flow divider forms a stepladder-like tapered face portion.

3. The gun flash hider according to claim 1, wherein the exhaust head has a surface which tapers inwardly toward the through hole.

4. The gun flash hider according to claim 1, wherein the plurality of first exhaust passages and the plurality of second exhaust passages are alternately arranged around the circumference of the exhaust head.

5. The gun flash hider according to claim 1, wherein the second flow divider forms a stepladder-like tapered face portion.

6. The gun flash hider according to claim 1, wherein gas discharged to the atmosphere from the first exhaust passages produces a high pressure gas wall at a periphery of the exhaust head and a vacuum region.

* * * * *